US005579727A

United States Patent [19]

Logan et al.

[11] Patent Number: 5,579,727

[45] Date of Patent: Dec. 3, 1996

[54] SEPARATING APPARATUS FOR THE COOLING SYSTEM OF A MARINE ENGINE

[75] Inventors: Andrew K. Logan, Stillwater, Okla.; Matthew W. Jaeger, Fond du Lac, Wis.; Terry D. Axton; William E. Hughes, both of Stillwater, Okla.; David J. Gruenwald, Butte des Monts, Wis.

[73] Assignee: Brunswick Corporation, Lake Forest, Ill.

[21] Appl. No.: 521,747

[22] Filed: Aug. 31, 1995

[51] Int. Cl.[6] ..... F01P 11/02

[52] U.S. Cl. ..... 123/41.14; 123/41.15; 210/251; 440/88

[58] Field of Search ..... 123/41.14, 41.15; 440/88; 210/251

[56] References Cited

U.S. PATENT DOCUMENTS

| | | | |
|---|---|---|---|
| 4,082,068 | 4/1978 | Hale | 123/41.02 |
| 4,693,690 | 9/1987 | Henderson | 123/41.14 |
| 4,758,190 | 7/1988 | Van Buren | 440/88 |
| 4,949,682 | 8/1990 | Klein | 123/41.15 |

OTHER PUBLICATIONS

"Dole Freeze Protection Valve", Easton Corporation.

*Primary Examiner*—Noah P. Kamen

*Attorney, Agent, or Firm*—Andrus, Sceales, Starke & Sawall

[57] ABSTRACT

An apparatus for separating solid material from cooling water in the cooling system of a marine engine. The apparatus includes a hollow member or housing having an inlet to receive cooling water and having an outlet. A drain opening is located in the housing above the bottom surface of the housing and is connected through a suitable conduit to a temperature responsive drain valve. A generally J-shaped tubular member is disposed in the housing and has one end connected to the drain outlet while a second end is slightly above the bottom surface of the housing, out of alignment with the inlet. When the drain valve is open, water will drain through the housing to the drain outlet, while solid debris will collect in the bottom of the housing beneath the second end of the tubular member.

12 Claims, 2 Drawing Sheets

FIG. 1
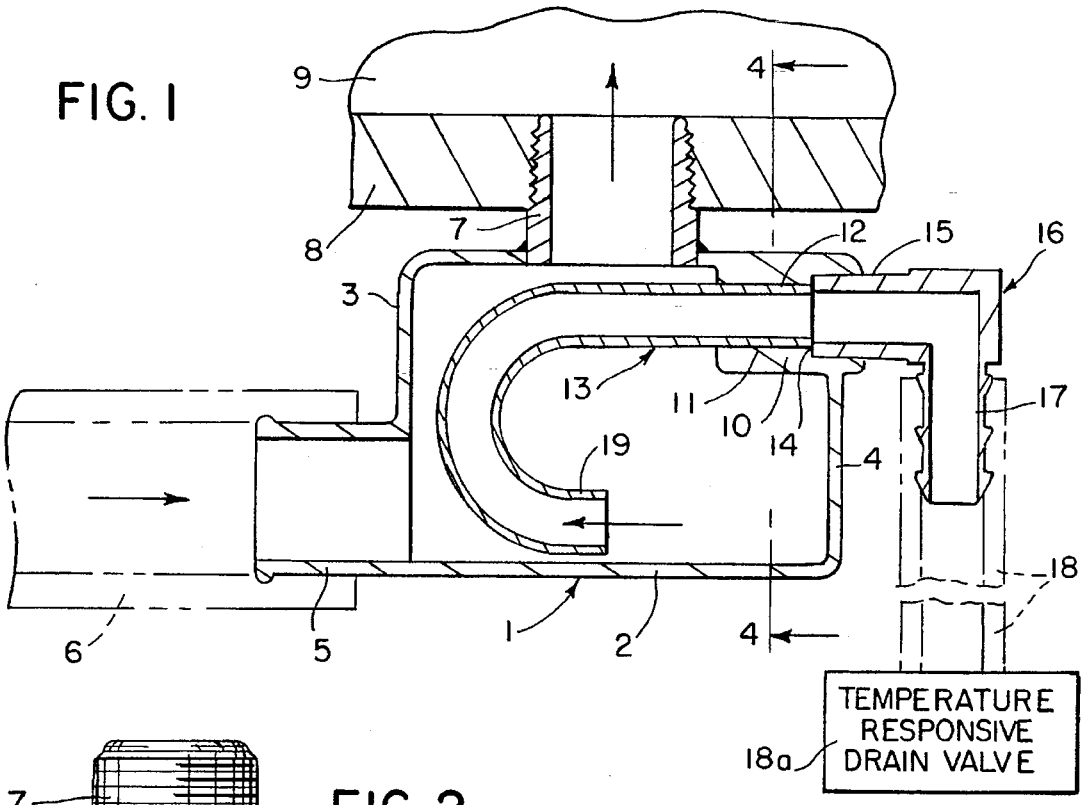
FIG. 2
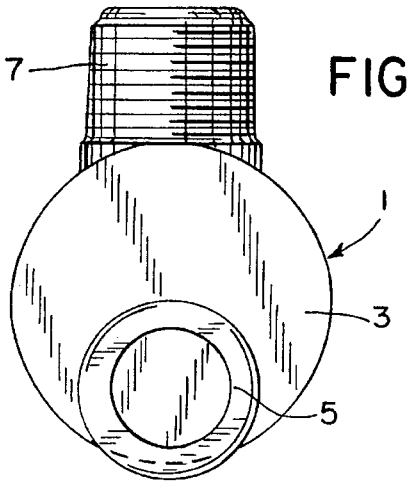
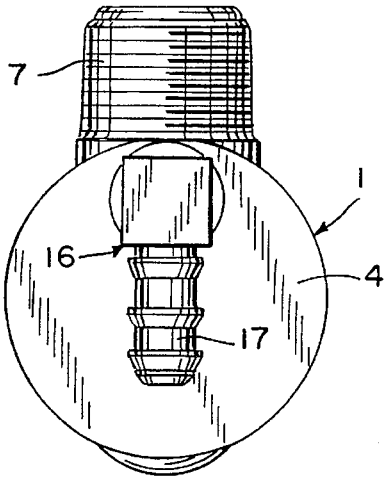
FIG. 3
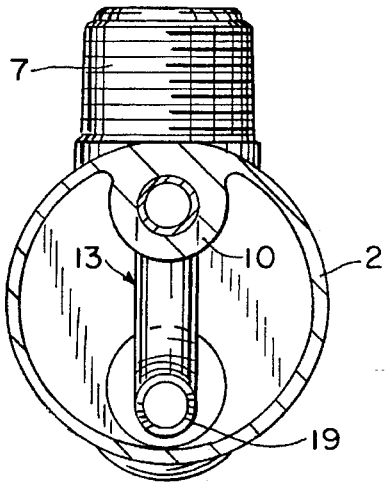
FIG. 4

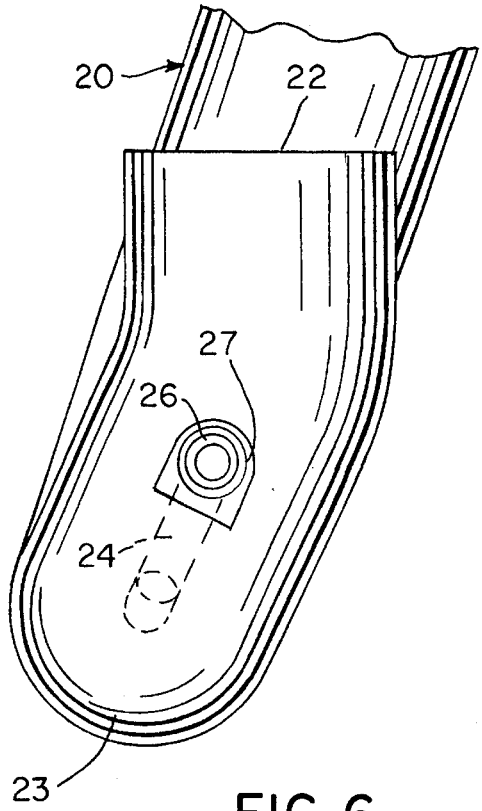
FIG. 6
FIG. 5
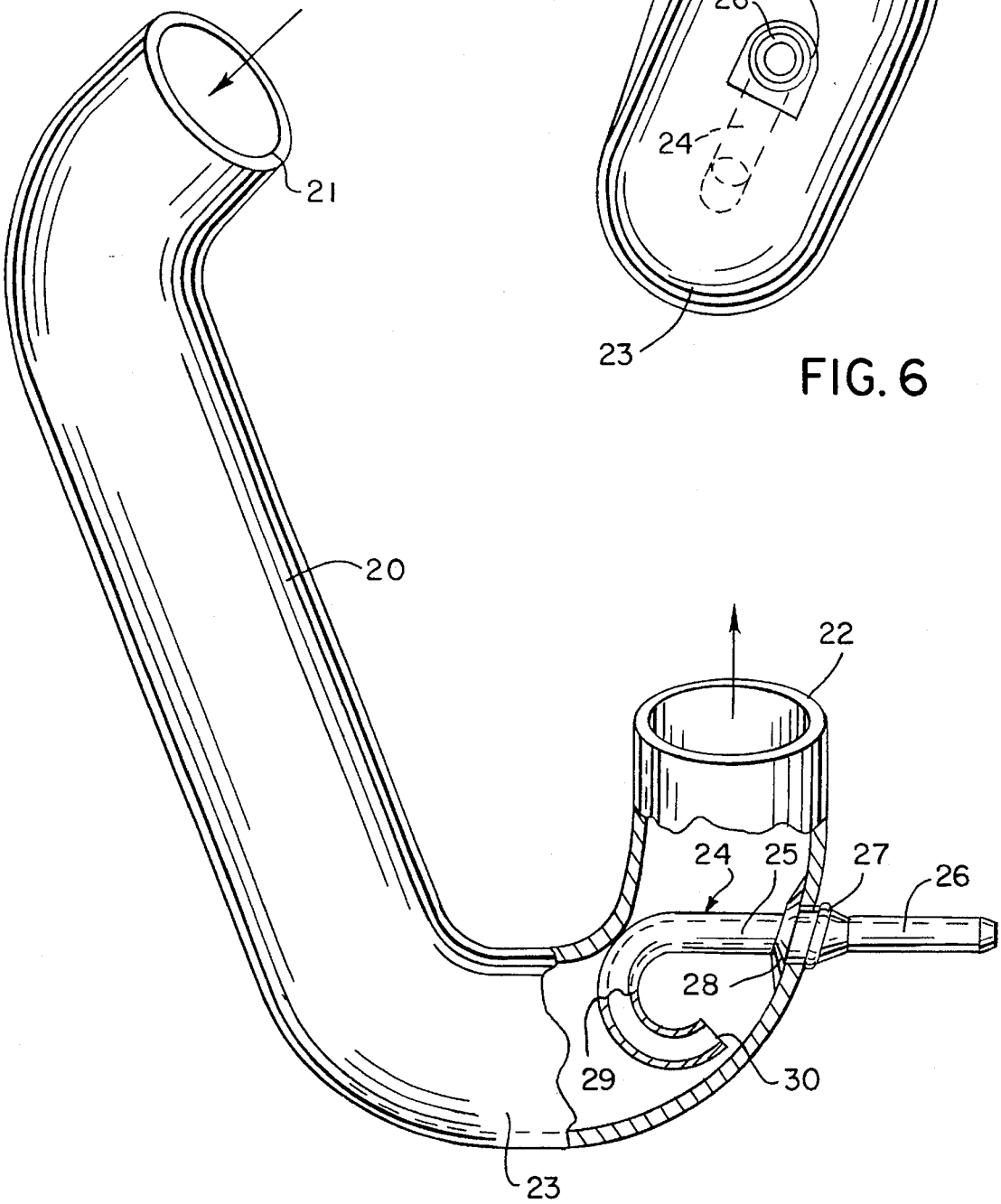

SEPARATING APPARATUS FOR THE COOLING SYSTEM OF A MARINE ENGINE

BACKGROUND OF THE INVENTION

A conventional inboard marine engine utilizes a cooling system in which seawater is drawn from the lake or other body of water and is circulated through the cooling system, and then discharged overboard. In a typical cooling system for V-6 inboard marine engine, seawater is drawn into the cooling system by a pickup pump, and is then directed to a thermostat housing, which contains a thermostat. When the thermostat is closed, a portion of the incoming water will be pumped by a circulating pump through outlets in the thermostat housing to the exhaust manifold and elbows of the engine, while a second portion of the incoming seawater is circulated through the engine block. As the temperature rises and the thermostat is opened, a portion of the returning water in the circulating system will flow to the exhaust manifolds, and then overboard in the exhaust of the engine.

When the engine is not operating, water will collect in certain portions of the cooling system, such as the exhaust manifold, the engine block and the circulating pump. If the ambient temperature drops below freezing for extended periods, the collected water can freeze, which can cause cracking of the engine block or other components of the engine. Because of this, it is customary to winterize the engine at the outset of cold weather. However, winterizing is a difficult and time consuming operation, but because of the potential danger of freezing, the marine engine is normally winterized well before the advent of freezing weather, thus substantially reducing the overall boating season.

The co-pending U.S. patent application Ser. No. 08/521,746 filed Aug. 31, 1995 and entitled Drain Valve for a Marine Engine, is directed to a drain valve assembly associated with an inboard marine engine for automatically draining water from the cooling system when the ambient temperature decreases below a preselected value, such as about 50° F. The drain valve of the above mentioned patent application is connected via hoses or conduits to the exhaust manifolds of the engine, the circulating pump hose, and the engine block. When the ambient temperature falls below the preselected value, the drain valve will open, thus draining water from these portions of the engine to prevent freezing of the water and potential damage to the engine.

The seawater which is circulated through the cooling system of the marine engine contains debris, such as sand, dirt, and other particulate material. In order for the drain valve to function effectively, it is necessary to keep the debris away from the drain valve. Debris entering the valve members can prevent flow, or debris lodging between the valve members and the valve seats can cause leakage through the valve.

SUMMARY OF THE INVENTION

The invention is directed to an apparatus for separating solid material or debris from cooling water in the cooling system of a marine engine, and has particular application for separating debris from cooling water that is discharged to a cooling system drain valve.

The apparatus includes a housing, or hollow member, preferably formed of a generally cylindrical shell having open ends that are enclosed by a pair of generally flat heads. An inlet opening is provided in the lower portion of first of the heads, and is connected through a suitable conduit to the cooling system of the engine so that seawater will be introduced into the housing through the inlet opening.

The housing is mounted to the lower portion of an exhaust manifold and the upper portion of the shell is provided with an outlet opening which communicates with a cooling passage in the manifold, so that cooling water entering the housing through the inlet will be discharged through the outlet to the cooling passage of the manifold.

A drain outlet is located in the upper portion of the second head of the housing, and the drain outlet is connected via a hose or conduit to a temperature responsive drain valve, which is characterized by the ability to open when the ambient temperature falls below a preselected value, such as about 50° F. When the ambient temperature is above 50° F. the drain valve will remain in the closed position, so that there will be no flow through the drain outlet to the drain valve. However, when the ambient temperature falls below 50° F., the drain valve will open and cooling water will then flow through the drain outlet and through the open drain valve for discharge overboard.

A generally J-shaped tubular member is located within the housing and one leg of the tubular member is connected to the drain outlet, while the second leg of the tubular member is located slightly above the bottom of the housing and faces in a direction away from the inlet.

Under normal operating conditions of the engine, cooling water will be pumped into the housing through the inlet and will be discharged through the outlet to the cooling passage of the manifold. Due to the flow of the cooling water, any debris in the water will be carried with the water flow into the cooling passage in the manifold and then discharged overboard.

If the engine is not operating and the ambient temperature falls below the 50° F., the drain valve will open, thus draining cooling water that may have collected in the housing as well as in the cooling passage of the exhaust manifold. Any solid debris in the cooling water flowing by gravity to the open drain valve will collect in the bottom of the housing, which is located below the inlet to the J-shaped tubular member, so that the debris will not be drawn through the tubular member to the drain valve. The construction of the tubular member also enables any water contained within the housing, beneath the level of the outlet in the housing, to be drawn through the tubular member to the drain valve by a siphoning effect, so that substantially all water will be removed from the housing, eliminating any potential water freezing problem in the housing.

Thus, the separating apparatus of the invention permits the solid debris to collect in the housing when the drain valve is opened to prevent the debris from contacting the drain valve, and yet the cooling water will be substantially removed from the housing by a siphoning action.

Other objects and advantages will appear during the coursed of the following description.

DESCRIPTION OF THE DRAWINGS

The drawings illustrate the best mode presently contemplated of carrying out the invention.

In the drawings:

FIG. 1 is a longitudinal section of the separator of the invention;

FIG. 2 is an end view taken along line 2—2 of FIG. 1;

FIG. 3 is an opposite end view taken along line 3—3 of FIG. 1;

FIG. 4 is a section taken along line 4—4 of FIG. 1;

FIG. 5 is a side elevation of a modified form of the invention; and

FIG. 6 is an end view of the construction shown in FIG. 5.

DESCRIPTION OF THE ILLUSTRATED EMBODIMENT

The drawings illustrate a separator for separating solid debris or material from cooling water that is being drained from an inboard marine engine through a temperature responsive drain valve. The separator has particular application for use with a drain valve of the type described in co-pending U.S. patent application Ser. No. 08/521,746, filed Aug. 31, 1995 and entitled Drain Valve For A Marine Engine, and the construction as shown in that patent application is incorporated herein by reference.

The drain valve as described in the aforementioned patent application, is mounted on a lower portion of the marine engine, and is connected via a plurality of hoses or conduits to various portions of the cooling system of the engine. Each drain hose is connected to an inlet in the valve assembly, and each inlet defines a valve seat which is engaged by a resilient valve member. The valve members are moved between a closed and open position by a temperature responsive element, and the valve assembly operates in a manner such that when the ambient temperature falls below a preselected value, such as perhaps 50° F., the valve members will open to permit the cooling water in the various portions of the cooling system of the engine to drain by gravity.

The separator as illustrated in the drawings is adapted to be connected to an exhaust manifold of the engine, and acts to prevent solid debris such as sand, dirt, small particles of leaves or seaweed, or other particulate material, from flowing from the manifold to the drain valve when the drain valve is open.

The apparatus of the invention includes a housing or hollow member 1, which is preferably formed of a generally cylindrical shell 2, having open ends which are enclosed by heads 3 and 4.

An inlet 5 is formed in the lower portion of head 3 and the inlet can be connected by a suitable hose or conduit 6 to the thermostat housing of the invention so that cooling water will be circulated by the circulating pump through conduit 6 to inlet 5.

Housing 1 is mounted to the lower portion of the exhaust manifold, and in this regard the upper portion of shell 2 is provided with an outlet 7 which is threaded within an opening in the exhaust manifold 8, so that the outlet 7 communicates with a cooling passage 9 in the manifold. Thus, under normal operation of the cooling system of the invention, cooling water will be pumped into the housing 1 through inlet 5, and will be discharged through outlet 7 into the cooling passage 9 of manifold 8.

The upper portion of shell 2 is formed with an enlargement or boss 10, having a opening or passage 11 therethrough. The upper end 12 of a generally J-shaped tubular member 13 is received within the inner end of passage 11, while a horizontal leg 15 of an L-shaped fitting 16 is located within the outer end of opening 11 and bears against a shoulder 14. The vertical leg 17 of fitting 15 is connected through a hose or conduit 18 to the temperature responsive drain valve **18*a* which is located at a lower level than housing 1**. The drain valve can have a construction as set forth in the previously mentioned United States Patent application.

As shown in FIG. 1, the lower end 19 of the J-shaped tubular member 13 is located slightly above the bottom surface of shell 2, and the end 19 faces in a direction toward head 4 and is out of alignment with the inlet 5, so that cooling water being pumped into the housing 1 will not directly flow into the end 19 of the tubular member.

The spacing between the lower extremity of end 19 of J-tube 13 and the lower surface of shell 2 is generally in the range of about 0.05 to 0.10 inch. Under normal operating conditions of the invention, cooling water will flow into the housing 1 through inlet 5 and be discharged through outlet 7 into the cooling passage 9 of manifold 8. During the normal operation the drain valve **18*a* will be closed so that there will be no flow of cooling water through the tube 13 or the hose 18 which is connected to the drain valve. When operation of the engine is terminated, the cooling water will collect in the housing 1 as well as in the cooling passage 9 of the manifold 8**.

If the ambient temperature falls below the pre-selected temperature, such as 50° F., while the engine is not operating, the drain valve **18*a* will open, thus permitting the cooling water in the housing 1 as well as in the cooling passage 9 of the manifold to drain through the tubular member 13 and conduit 18 to the drain valve, and the cooling water is then discharged overboard. Solid debris which may be in the cooling water contained within the housing 1 or cooling passage 9 will settle to the bottom of housing 1 beneath the inlet end 19 of the tubular member, and will not be drawn through the tubular member to the drain valve. While the solid debris will be retained within housing 1, substantially all of the water in the housing will be drained through conduit 18 to the drain valve 18*a* due to the siphoning effect achieved by virtue of the mounting of the drain valve at a lower level than that of the housing 1. Any small amount of water retained in housing 1 beneath the inlet end 19 of the J-tube 13 would not pose a problem if it should freeze. Thus, the invention will minimize the quantity of debris which flows through the tubular member 13 and conduit 18 to the drain valve 18*a*, but will enable substantially all of the water in housing 1** to be drained therefrom to prevent freezing.

If the engine is restarted while the drain valve is open, a portion of the cooling water entering housing 1 through inlet 5 will flow through the tubular member 13 and the open drain valve, while the major portion of the cooling water will flow through the outlet 7 to the manifold. As the engine temperature increases, the engine heat will heat the temperature responsive element in the drain valve above the preselected temperature, thus automatically closing the drain valve, and discontinuing flow of cooling water through tubular member 13 and conduit 18.

Any debris that may have collected in the bottom of housing 1 during the draining operation will be swept along with the cooling water and discharged through outlet 7 to the cooling passage 9 of manifold 8.

FIGS. 5 and 6 illustrate a modified form of the invention, in which the separator is associated with the suction hose or conduit that is connected to the circulating pump of the marine engine. The conduit or hose 20 includes an inlet end 21 and an outlet end 22, and cooling water is circulated through the conduit by the circulating pump of the engine. Conduit 20 is generally J-shaped in configuration having a central portion 23 which is at a lower level than the inlet 21 and outlet 22, so that on draining of the cooling system, water will tend to collect in the low portion 23.

A generally J-shaped tubular member 24, similar to tubular member 13 of the first invention, is located in conduit 20 adjacent the low portion 23. Tubular member 24 includes a generally horizontal upper leg 25 which extends through an opening in the wall of conduit 20 and terminates in a tubular connector 26, which can be connected through a suitable hose (not shown) to the temperature responsive drain valve. Connector 26 is provided with an enlarged flange 27, which bears against the outer surface of conduit 20, while an annular sealing disc or washer 28 is mounted on the leg 25 and bears against the inner surface of the conduit. Alternately, J-shaped tubular member 24 can be molded into the conduit 20.

Tubular member 24 also includes a generally curved central section 29 which terminates in an inlet 30. End 30 is located slightly above the inner wall of conduit 20 and faces away from the normal direction of flow of water in conduit 20.

When the ambient temperature falls below the pre-selected value, such as 50° F., the drain valve will open and the water in conduit or hose 20 will drain through the tubular member 24 to the drain valve. As the inlet end 30 is located slightly above the lower portion of conduit 20, solid particles or debris will tend to settle in the lower section 23 a bed will not be drawn through the tubular member 24 to the open drain valve. The syphoning effect will drain the water in the curved section 23 of the conduit from the level of the upper leg 25 to the inlet 30. Any small amount of remaining water will not pose a problem if it should freeze in the conduit or hose.

We claim:

1. An apparatus for separating solid material from cooling water in the cooling system of a marine engine, comprising a hollow member having an inlet to receive cooling water and having an outlet connected to a cooling passage in said engine, said hollow member also having a drain outlet connected to a temperature responsive drain valve, and a tubular member having a first end communicating with the interior of the hollow member and a second end connected to said drain outlet, said first end located adjacent a bottom surface of said hollow member and being disposed out of alignment with said inlet.

2. The apparatus of claim 1, wherein said first end of the tubular member faces in a direction away from said inlet.

3. The apparatus of claim 1, wherein said tubular member is generally J-shaped.

4. The apparatus of claim 1, wherein said drain outlet is at a lower vertical level than said outlet.

5. An apparatus for separating solid material from cooling water in the cooling system of a marine engine, comprising a housing composed of a generally cylindrical shell having opposed open ends, a first head enclosing one of said open ends, a second head enclosing a second of said open ends, inlet means in said first head for introducing cooling water into said housing, outlet means disposed in an upper portion of said shell for discharging cooling water to a cooling passage of said engine, drain opening means disposed in said second head, and a generally J-shaped tubular member having a first end communicating with the interior of said housing and having a second end connected to said drain opening means, said first end of the tubular member being located slightly above the bottom surface of said shell and facing in a direction away from said inlet means.

6. The apparatus of claim 5, wherein the axis of said inlet means is located at a vertical level below the axis of said drain opening means.

7. The apparatus of claim 5, wherein said first end of said tubular member faces toward said second head.

8. The apparatus of claim 7, wherein said J-shaped tubular member includes a first generally horizontal leg terminating in said first end and a second generally horizontal leg terminating in said second end, said tubular member also including a curved central section connecting said first and second legs.

9. The apparatus of claim 5, wherein said first end of the tubular member is spaced from 0.05 to 0.10 inch above the lower portion of said shell.

10. A marine inboard engine, comprising an exhaust manifold having a cooling passage therein, a housing mounted on the lower portion of said manifold, said housing having an inlet to receive cooling water and having an outlet communicating with the cooling passage of said manifold, said housing also having a drain outlet connected to a temperature responsive drain valve, and a tubular member disposed in said housing and having a generally J-shaped configuration, said tubular member having one end communicating with the interior of said housing and having a second end connected to said drain outlet, the first end of said tubular member being located slightly above the bottom surface of said housing and said first end facing in a direction away from said inlet.

11. An apparatus for separating solid material from cooling water in the cooling system of a marine engine, comprising a hollow member having an inlet to receive cooling water and having an outlet to discharge cooling water, said hollow member including a central portion located between said inlet and outlet and disposed at a lower level than said inlet and outlet, said hollow member also having a drain outlet connected to a temperature responsive drain valve and located at a level above said central portion, and a tubular member disposed within said hollow member and having a first end communicating with the interior of said central portion and a second end connected to said drain outlet, said first end being located slightly above a bottom surface of said central portion and facing in a direction away from said inlet.

12. The apparatus of claim 11, wherein said tubular member is generally J-shaped and includes a first generally horizontal leg terminating in said first end and a second generally horizontal leg terminating in said second end and a central curved section connecting said first and second legs.

* * * * *